US005131859A

United States Patent [19]

Bowen et al.

[11] Patent Number: 5,131,859

[45] Date of Patent: Jul. 21, 1992

[54] QUICK DISCONNECT SYSTEM FOR CIRCUIT BOARD MODULES

[75] Inventors: Stephen A. Bowen; Melvin C. August, both of Chippewa Falls; Stephen Cermak, III, Elk Mound; David R. Collins, Eau Claire; Steven J. Dean, Chippewa Falls; Perry D. Franz, Elk Mound; Max C. Logan, Chippewa Falls, all of Wis.

[73] Assignee: Cray Research, Inc., Chippewa Falls, Wis.

[21] Appl. No.: 666,356

[22] Filed: Mar. 8, 1991

[51] Int. Cl.[5] ..... H01R 4/64

[52] U.S. Cl. ..... 439/194; 439/196; 439/857; 361/382; 361/415; 251/149.6; 165/80.4

[58] Field of Search ..... 439/61, 62, 64, 108, 439/190, 191, 194, 196, 485, 825, 827, 857; 361/382, 385, 386, 392, 393, 395, 412, 413, 415; 251/142, 149, 149.6; 165/80.4, 185

[56] References Cited

U.S. PATENT DOCUMENTS

| | | | |
|---|---|---|---|
| 3,411,041 | 11/1968 | Block | 361/382 X |
| 3,453,587 | 7/1969 | Neidecker . | |
| 3,917,370 | 11/1975 | Thornton et al. | 439/196 X |
| 4,315,300 | 2/1982 | Parmerlee et al. | 361/382 |
| 4,398,561 | 8/1983 | Maldavs | 251/149.6 X |
| 4,750,897 | 6/1988 | Neidecker | 439/825 |
| 4,810,213 | 3/1989 | Chabot | 439/825 |
| 4,821,145 | 4/1989 | Corfits et al. | 439/108 X |
| 4,862,326 | 8/1989 | Blomstedt et al. | 439/857 X |
| 4,884,168 | 11/1989 | August et al. | 361/382 |
| 4,889,959 | 12/1989 | Taylor et al. | 439/108 X |
| 4,939,624 | 7/1990 | August et al. | 361/424 |
| 4,962,444 | 10/1990 | Niggemann | 361/445 X |
| 4,984,993 | 1/1991 | Neumann | 439/157 |

FOREIGN PATENT DOCUMENTS 1665132 4/1967 Fed. Rep. of Germany .

*Primary Examiner*—Larry I. Schwartz
*Assistant Examiner*—Khiem Nguyen
*Attorney, Agent, or Firm*—Merchant, Gould, Smith, Edell, Welter & Schmidt

[57] ABSTRACT

A circuit board module for a supercomputer includes quick connections for power, ground, coolant quick connects, and circuit quick connects. The quick connections provide for insertion of modules with substantial savings in time and effort. The electrical power and ground connections and the liquid coolant connections engage and disengage automatically upon insertion and removal of the modules. The circuit quick connects require only insertion of a camming tool for connection and disconnection. The modules require no bolting or unbolting of clamps or hoses for the various connections.

18 Claims, 4 Drawing Sheets

QUICK DISCONNECT SYSTEM FOR CIRCUIT BOARD MODULES

BACKGROUND OF THE INVENTION

1. Field of the Invention

The present invention relates to circuit board connections to the computer frame, for power, for cooling and to other boards.

2. DESCRIPTION OF THE PRIOR ART

High speed supercomputers of the type produced by Cray Research, Inc., the assignee hereof, utilize stacks of interconnected circuit modules. Each circuit module typically includes a pair of printed circuit boards mounted on opposite sides of a heat sink, commonly referred to as a cold plate, or a pair of cold plates sandwiched by two or more boards. Each circuit board in turn includes numerous integrated and discrete circuit, logic, and memory devices. The cold plates have liquid coolant filled channels winding back and forth to carry heat away. The stacks of boards require large electrical power and ground connections as well as circuit connections. In addition, the stacks have liquid coolant pumped throughout the cold plates and need liquid coolant inputs and outputs.

The power and ground connections should have as large an area as is reasonably possible. The electrical resistance decreases as the cross sectional area through which the current flows increases. Therefore, it is advantageous to provide connections having a very large area of contact to optimize performance.

It is also necessary to provide both an input and an output for liquid coolant. The coolant is pumped through channels winding back and forth in the cold plate between pairs of boards in a module and through a heat exchanger before returning to the module.

Considerable time must also be spent connecting and disconnecting the connections for input and output signals to the circuit boards. Hundreds of connections must be made and proper alignment and connection of each electrical connector is critical.

Should problems develop with a board and repair or replacement be required, the module must be removed so that the repair work may be conducted. The supercomputer down time is quite costly so that it is important to have the repairs completed as quickly as possible. Removing and replacing a board has heretofore taken on the order of at least 30 minutes. A substantial portion of that time is spent bolting and unbolting the connections between the board and the frame. In addition, since the channels between the boards are substantially horizontal and are filled with coolant, great care must be taken so that no spilling occurs which may damage computer components. A quicker connect and disconnect would save a substantial amount of time and greatly reduce repair costs due to computer downtime. Automatic connection and disconnection and alignment would increase reliability and minimize repair time.

It can be seen then, that a circuit board module is needed which connects to a computer frame that provides for quick and reliable connection and disconnection of the several types of inputs and outputs of circuit boards to decrease module repair and replacement time. Quick and reliable connections are needed for liquid coolant, electrical power, electrical ground, and input and output signals from the module. The present invention addresses these and other problems associated with computer circuit board modules.

SUMMARY OF THE INVENTION

The present invention is directed to a quick connection apparatus for a computer circuit board module such as is used in supercomputers. The modules are slid into a channeled frame in the computer in a stacked configuration. Each module having two cold plates and at least two circuit boards layered around each cold plate so that the cold plates dissipate the heat from the boards. According to the present invention, quick connects and disconnects are provided for electrical power and ground, for connections from the edges of the circuit boards for input and output signals, and for liquid coolant. According to the present invention, the modules can be inserted into the board stacks and removed without bolting and unbolting connections for the various inputs and outputs to and from the modules.

The electric power connections are made from the modules to the power bus with compliant power conductors on a rear end of the modules engaging bus bars of the power buses. The compliant conductors provide for insertion of modules and automatic engagement of the electrical contacts without additional steps being taken. The compliant conductors are compressed slightly upon insertion so that curved contactor bars remain in contact with the power bus bars. Similarly, upon removal of the modules, the contactor bars slide out from between the bus bars without any additional steps required for unlocking.

The electrical ground connections from the modules are made with compliant conductors engaging a ground block of a fluid manifold. The ground block has bars extending therefrom engaging the compliant conductors of the module ground. The curved contactor bar of the compliant conductors automatically engage the bars upon sliding the modules into the computer frame. The compliant conductors slide out of contact with the bars of the ground block upon removing the module.

The coolant connections from the cold plate to coolant lines are made with quick disconnect type couplings. The couplings are on the rear of the module extending from the cold plate inward toward the fluid manifold. Upon sliding a module into the computer frame, the coupling automatically engages and seals. The coupling has a first portion which has a sliding spring loaded plunger inside a stationary sleeve. The second portion has a stationary plunger inside a sliding spring loaded sleeve. Upon pushing the two portions together, the stationary plunger engages the sliding plunger and pushes it back while the stationary sleeve engages the sliding sleeve, pushing the sliding sleeve back. With the sliding plunger and sliding sleeve pushed back, the coupling has a flow path opened up around the plungers. The sleeves are engaged during the period that the flow path is opened up, so that there is no leakage. Upon pulling the two portions apart, the spring loaded sleeve and the spring loaded plunger are biased back to the closed position, automatically cutting off the flow.

The electrical connections for input and output signals to and from the circuit boards are made along the edges of the module with zero insertion force type (ZIF) connectors. The ZIF connectors have shuttle blocks aligned along the edges of the circuit boards which are urged into contact and out of contact with receiving portions on the boards. After the module is inserted into the frame, a camming tool is slid along the ZIF connectors forcing the connectors into contact. To disconnect the ZIF connectors, the camming tool is rotated 180 degrees and slid along the ZIF connectors, disengaging the connectors. The ZIF connectors provide for quick connection and disconnection and the shuttle blocks automatically align the connections for input and output signals.

The connections and disconnections for the inputs and outputs to the modules are made with a minimum of time. The connections provide improved reliability and decrease computer down time for module repairs.

These and various other advantages and features of novelty which characterize the invention are pointed out with particularity in the claims annexed hereto and forming a part hereof. However, for a better understanding of the invention, its advantages and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
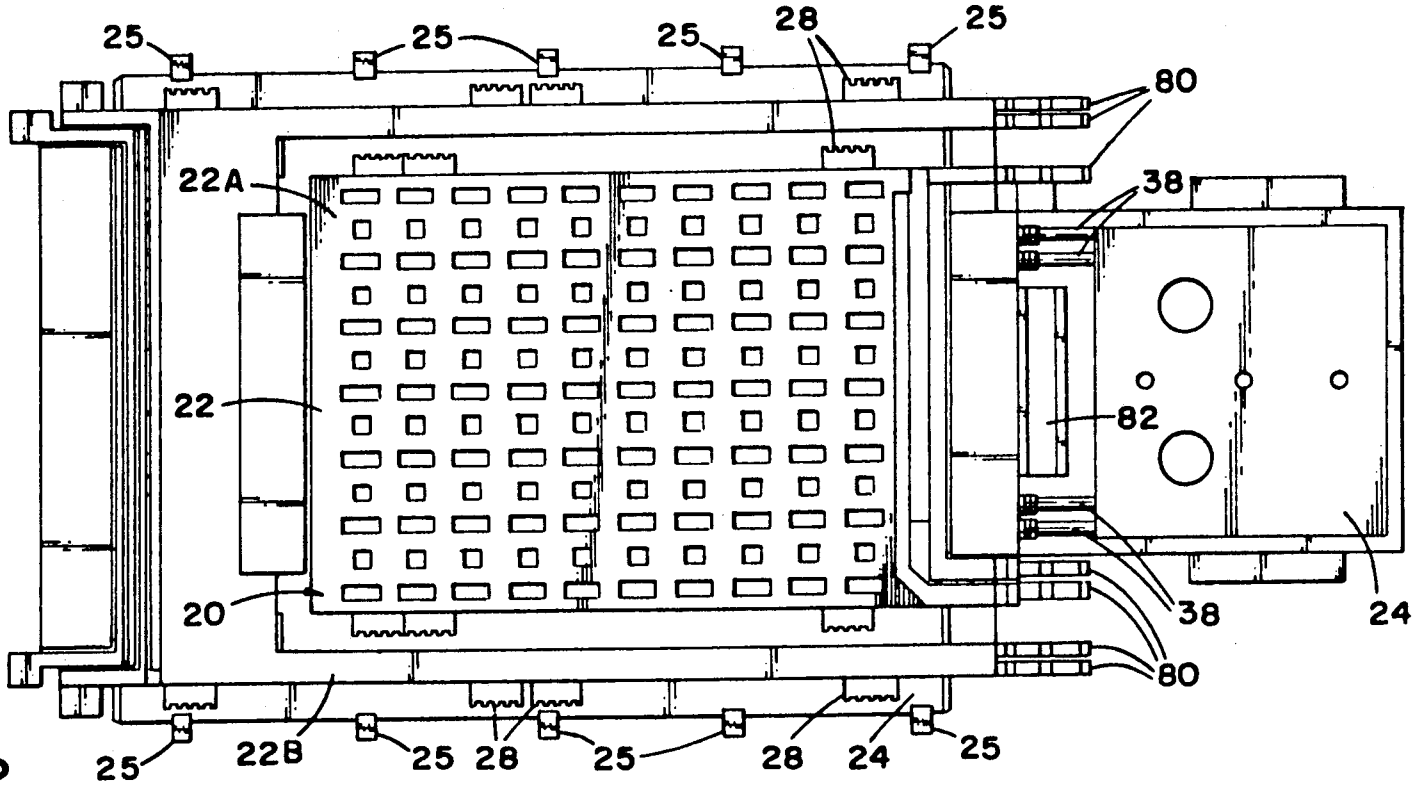
FIG. 1 is a top view of the stack of board modules showing both memory and logic boards and connections to the boards according to the principles of the present invention.
Figure 2:
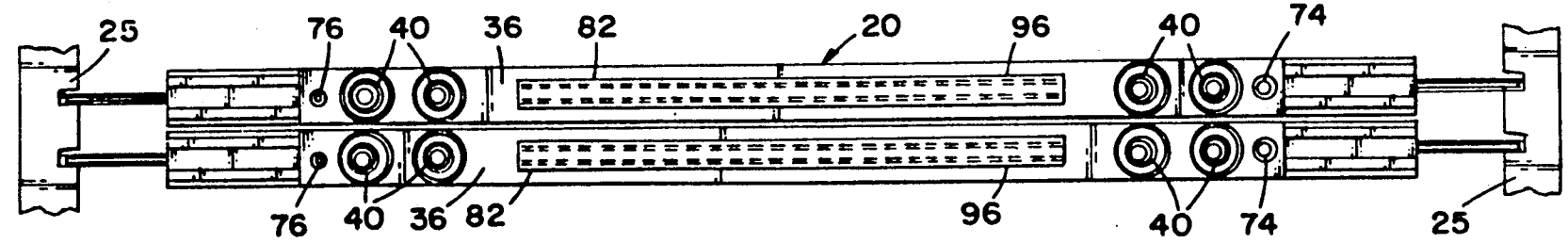
FIG. 2 is an end view of a module shown in FIG. 1 showing the coolant disconnects.

Referring now to the drawings, in FIG. 1 there is shown a circuit board module 20 as is commonly used in supercomputers. In the preferred embodiment, each module 20 has two cold plates 36 with at least one pair of circuit boards 22 sandwiching each cold plate 36. The modules 20 are stacked in a computer frame 25 with a stack of memory board modules **20*a* placed above a stack of central processing unit (cpu) modules 20*b*. The modules 20 are inserted with a rear end inserting into the computer frame 25 toward a fluid manifold 24 and a front end facing the outer side of the computer. Edges of the cold plates 36 insert into slots of the frame 25 as shown in FIGS. 1 and 2 for aligning and supporting the modules 20. Although in the preferred embodiment, the memory boards of the memory board modules 20*a* are slightly larger than the cpu boards of the cpu modules 20*b*, the various connections and the advantages gained by the present invention apply to both types of boards and modules. A more detailed description of a circuit board module is set forth in U.S. Pat. No. 4,939,624 assigned to Cray Research, Inc., incorporated herein by reference. A more detailed description of the cold plate 36 is set forth in U.S. Pat. No. 4,884,168 assigned to Cray Research Inc., incorporated herein by reference. The boards 22 contact the cold plate 36 along the Z-axis to carry heat away from the boards 22**.

The electrical connections for input and output signals to and from the boards 22 are made at the sides of the circuit boards 22 with zero insertion force (ZIF) connectors 28. Each ZIF 28 has a number of connectors mounted on a sliding shuttle block which assures proper alignment. The blocks are engaged by a rod, commonly known as a connector cam, having a tapered edge, which is slid along the row of ZIF connectors 28. The tool is rotated 180 degrees and slid along the row of ZIF connectors 28 in a second position to disengage each ZIF. The ZIF connectors 28 attach along both edges of the memory boards **22*a* and the cpu boards 22*b* as shown in FIG. 1. A more detailed description of the ZIF connectors 28** is set forth in U.S. Pat. No. 4,984,993 assigned to Cray Research, Inc., incorporated herein by reference.

Figure 3:
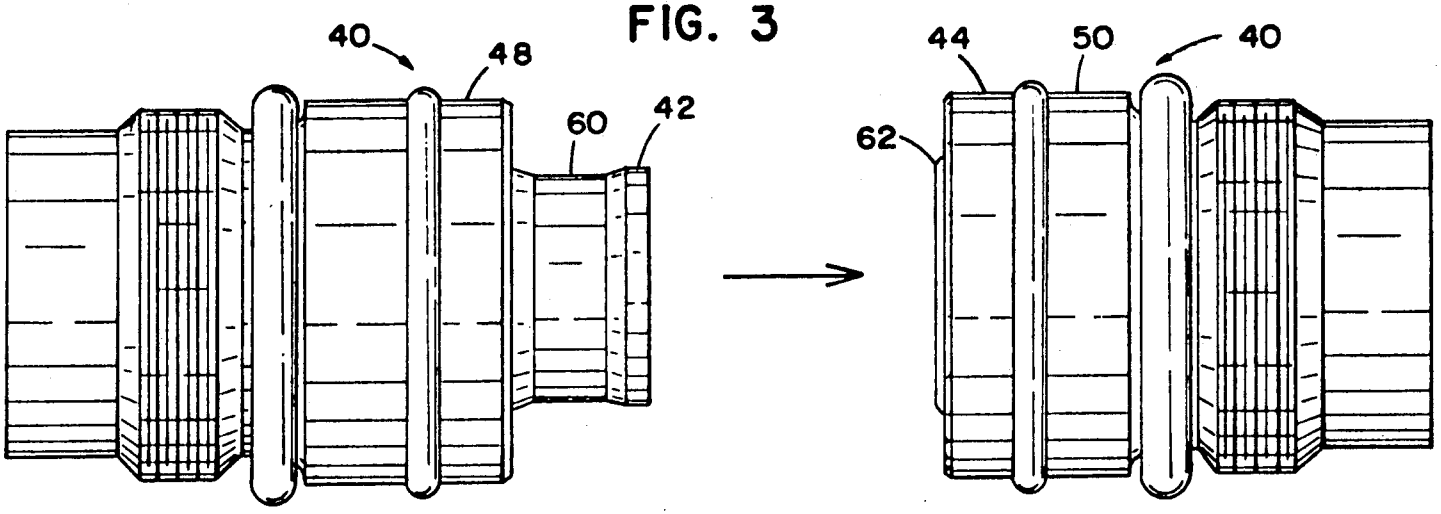
FIG. 3 is a detailed side elevational view of the coupling for the coolant.
Figure 4:
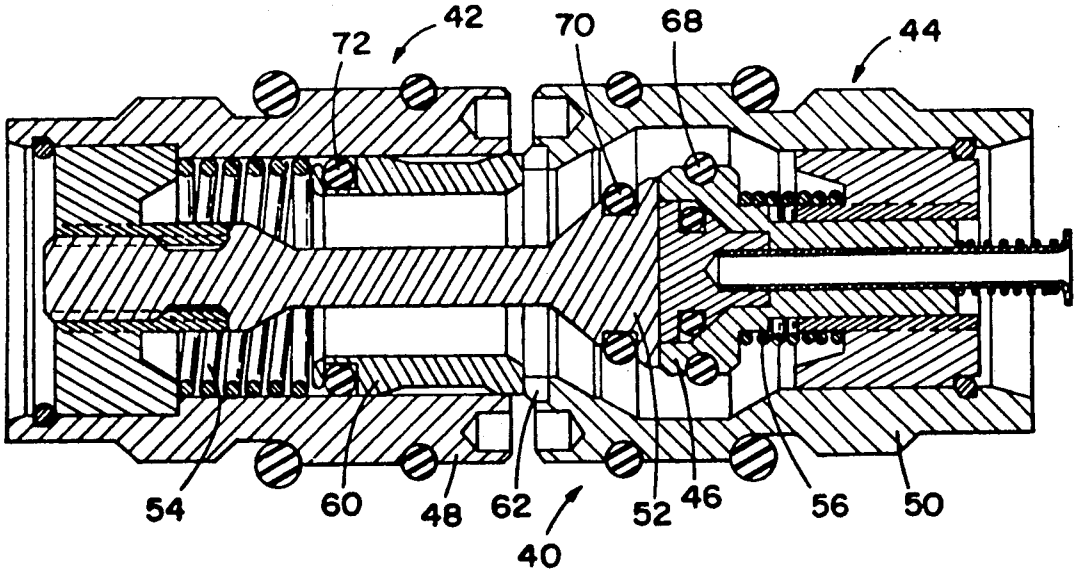
FIG. 4 is a sectional of the coupling shown in FIG. 3.

The connections for coolant inlet and outlet are positioned at the rear of the board as shown in FIGS. 1 and 2, near the edges of the cold plate 36. The modules 20 also have alignment pins 74 and 76 extending from the ends of the module 20 which engage slots of the fluid manifold. In the preferred embodiment, the pins 74 are larger than the pins 76 so that the module 20 is inserted with the correct side facing up. Coolant coupling 40 is a quick disconnect type coupling which automatically opens and closes upon engagement of the connectors. As shown in FIGS. 3 and 4, the coupling has a male connector 42 inserting into a female connector 44. The couplings lock off the flow both in the cooling plate 36 and in coolant inlet and outlet lines 38 in fluid manifold 24.

The female connector 44 has an outer housing 50, shown in FIG. 3. As shown in FIG. 4, the female connector 44 has a sleeve portion 62 surrounding a spring loaded plunger 46. The plunger 46 is biased toward a closed position by spring 56 engaging the housing 50. When not coupled, the plunger 46 is forced against the housing 50, thereby closing off flow through the female connector 44. The female connector 44 has an 0-ring type gasket 68 around the plunger 46 making a tight seal to shut off all flow and prevent leakage. The plunger 46 also has a pressure relief valve 64. If the fluid pressure becomes too high when the connectors 42 and 44 are not coupled, the relief valve 64 releases, preventing damage to the cooling system.

The male connector 42 has a stationary plunger 52 extending from the end of housing 48. A sliding sleeve 60 is forced by spring 54 against the plunger 52 and housing 48 when uncoupled. The sleeve 60 makes a seal with gasket 72 against the housing 48 and gasket 70 against the plunger 52. As the connectors 42 and 44 are pushed together, the stationary sleeve 62 of the female connector 44 engages the spring loaded sleeve 60 of the male connector 42. The sleeve 60 is pushed back, opening up a flow path in the male connector 42. At the same time, the stationary plunger 52 of the male connector 42 engages the spring loaded plunger 46 of the female connector 44, opening up a flow path around the plungers 46 and 52.

As the connectors 42 and 44 are pulled apart, the sliding sleeve 60 is pushed by the spring 54 against the sleeve 62. Similarly, the sliding plunger 46 is pushed by the spring 56 against the plunger 52. The seal between the sleeves 60 and 62 does not break until engaging the plungers 46 and 52, whereat a seal is established between the plungers and sleeves, so that at no time is there leakage through the coupling 40.

It can be seen that the coupling 40 provides for automatic opening and shutoff upon pushing the connectors 42 and 44 together and pulling the connectors apart. The coupling 40 requires no twisting or tools for attachment or detachment. Spilling is minimized and time and effort required for attachment and detachment is greatly reduced, as no cumbersome clamps or bolts are needed.

Figure 5:
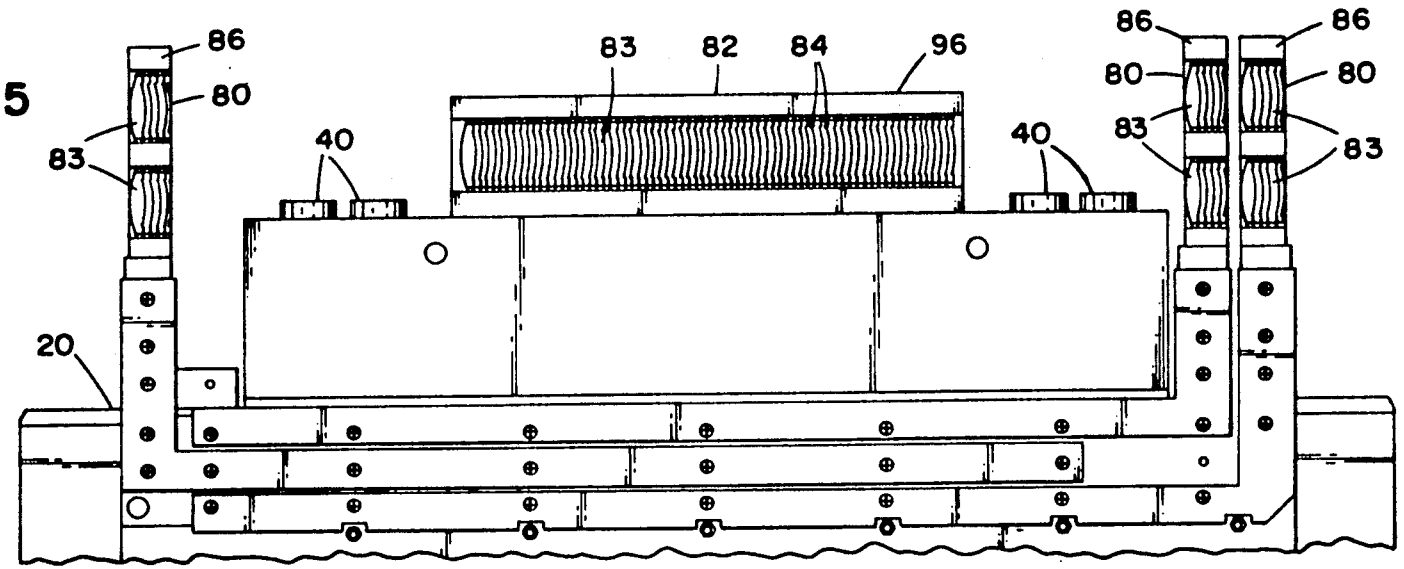
FIG. 5 is a top view of the module power and ground connections.

As shown in FIG. 5, the electrical power and ground contacts 80 and 82 between the boards and the buses are compliant conductors 83. The power connectors 80 extend from ends of the modules 20 positioned outside of the cold plate inlet and outlet connections 40. The compliant conductors 83 are arranged in strips having a plurality of curved contact bars 84 extending up from the surface in a generally convex curve. The power connections 80 have the compliant contactor strips 83 mounted on tops and bottoms of arms 86 extending from the rear of the module 20. The arms 86 are preferably mounted on the rear of the modules 20, with either three or four arms 86 extending from the module 20, depending on the type of module. In addition, the arms 86 may be mounted on the front of the modules 20 contacting power buses at the front of the modules, as may be required for memory board modules 20*a*.

Figure 8:
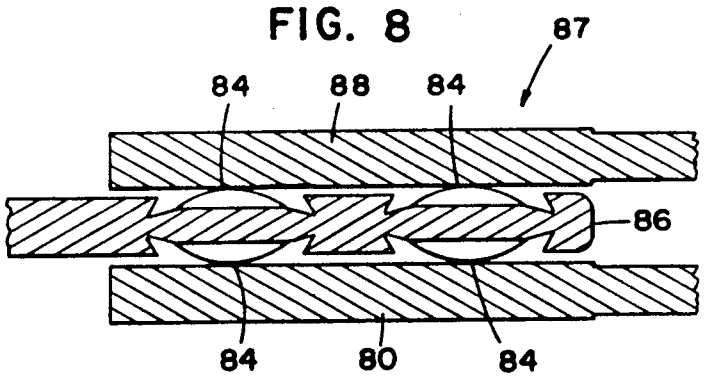
FIG. 8 is a side view of the power connections shown in FIG. 5.

As shown in FIG. 8, the strips 83 extend up slightly more than the space provided for by the space between bars 88 of a power bus 87. Since the contactor strips 83 are resilient, upon inserting a module 20 into the computer, the generally rounded surfaces of the bars 84 of the contactor strips 83 engage the bars 88 of the power bus 87 and are pressed down slightly, thereby increasing the contact area between the bars 84 and 88, the resiliency of the contactor bars 84 maintaining contact with the bus bars 88.

Figure 6:
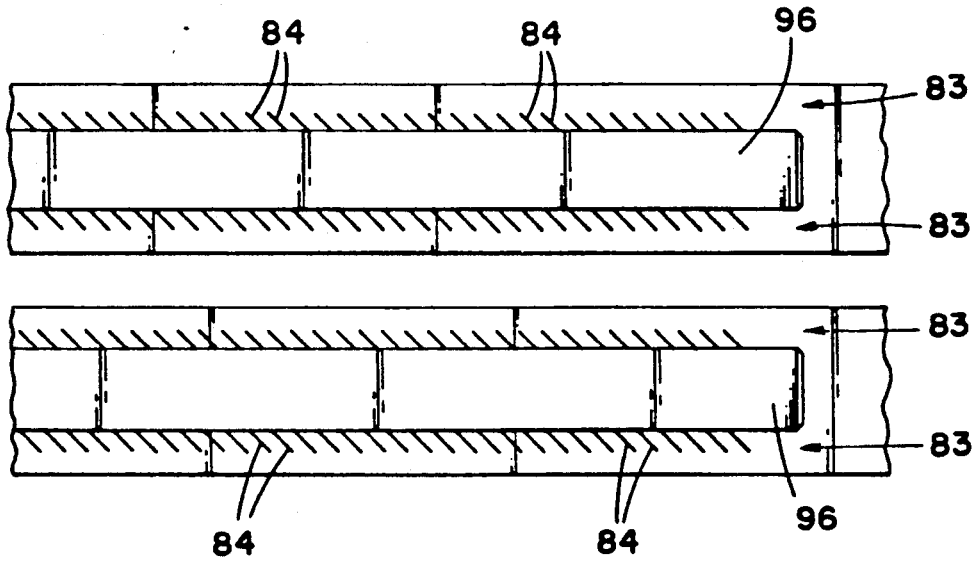
FIG. 6 is a detailed end view of the ground connections shown in FIG. 5.

As shown in FIG. 6, the contact bars 84 are slightly angled in the preferred embodiment so that they are not damaged or bent in the wrong direction upon insertion or removal. It can be seen that a large number of contact bars 84 come into contact with a flat surface pressing down on the bars. Since the contact bars 84 are preferably made of an elastic highly conductive material, the strips of compliant conductors 83 can be pulled out and reinserted and repeatedly maintain good electrical contact. The contact bars 84 are curved so that when pressed against the flat surface, the contact area is increased, minimizing resistance. The curved shape also provides for easy sliding of the strips 83 relative to the flat surface with little abrasion.

Figure 7:
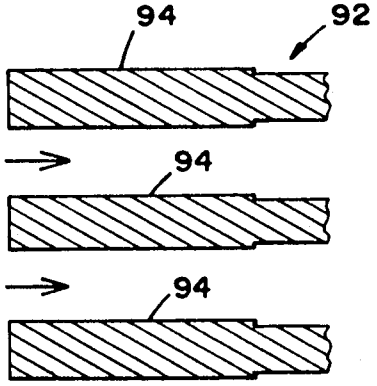
FIG. 7 is a side view of the ground connections shown in FIG. 6.
Figure 7:
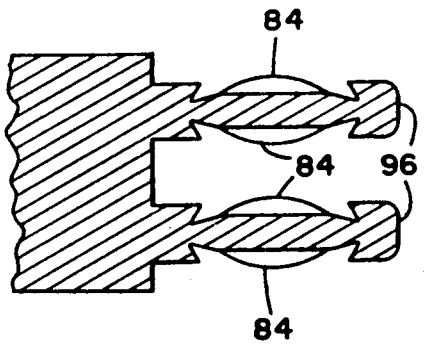

As shown in FIG. 7, a manifold ground block 92 extending vertically with the stacks adjacent the fluid manifold is configured for receiving the ground connections 82 with ground bars 94 extending from the ground block 92 for receiving module ground bars 96 at the rear of the module 20 having compliant conductor strips 83 mounted thereon. The ground bars 94 engage the strips 83 mounted on the tops and bottoms of the module ground bars 96 mounted on the rear of the modules 20. The grounding path leads through the cold plates 36 to the bars 96 extending from the modules 20. The modules 20 are grounded to the ground block 92 of the fluid manifold 24. As with the power connections, the space between the ground bars 94 is slightly less than the distance between the apexes of the contact bars 84 so that upon insertion, the contact bars are slightly compressed, increasing contact area.

As shown in FIG. 8, the power buses 87 are configured for receiving the electrical power connectors 80 for the modules 20. The bus bars 88 receive the double conductor strips 83 mounted on both the top and bottom of arms 86 extending from the rear of the modules 20. The distance between the bus bars 88 is slightly smaller than the distance between the apexes of the opposing curved contact bars 84 of the compliant conductor strips 83, so that upon being pushed between the bus bars 88, the contact bars 84 are pushed inward, compressing slightly and increasing their contact area. The resiliency and elasticity of the contact bars 84 exerts slight pressure against the top and bottom of the bus bars 88, so that contact is maintained and the electrical path is not broken.

In addition to automatic opening and closing of the coolant couplings 40, the electrical ground contacts 82 and the power inputs 80 automatically engage upon insertion of the module 20 into the computer frame 25 while the pins 74 and 76 assure proper alignment. In addition, the ZIF connectors 28 are aligned upon insertion of the module 20 and then require only insertion of a camming tool along each edge of a boards 22 to connect the ZIF connectors 28.

To remove a module 20, the camming tool is reversed and slid past the ZIF connectors 28 to slide the blocks out of engagement. The module 20 can then be pulled out with the power connections 80 and ground connections 82 slidably disengaging. The coolant couplings 40 also disengage and automatically shut off flow. It can be seen that no bolting or unbolting, locking or unlocking or other type of additional connections are required.

Even though numerous characteristics and advantages of the present invention have been set forth in the foregoing description, together with details of the structure and function of the invention, it is to be understood that the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A quick connection apparatus for a multilayer circuit board assembly having board modules including at least one cooling plate between at least two circuit boards, the connection apparatus connecting each board module to a supporting frame of a computer in a stacked configuration, comprising:

a) coolant quick connect means for making quick connections and disconnections between the module and liquid coolant lines having a first member with a sliding plunger and a stationary sleeve and a second member with a sliding sleeve and a stationary plunger, wherein the sliding sleeve engages the stationary sleeve and the sliding plunger engages the stationary plunger so that upon pushing the members together, the sliding sleeve is pushed back by the stationary sleeve and the sliding plunger is pushed back by the stationary plunger, opening a flow path;

b) power supply quick connect means for making quick connections and disconnections between the modules and an electrical power supply;

c) electrical ground quick connect means for making quick connections and disconnections between the modules and an electrical ground of the computer;

d) input and output signal quick connecting means for making quick connections and disconnections between the modules and electrical connections for input and output signals to and from the circuit boards.

2. A quick connection apparatus according to claim 1, wherein the power supply quick connect means comprises a power bus extending from the bottom to the top of the stack of boards and having bars extending therefrom wherein each board has compliant conductor type connectors making contact with the bars of the power bus.

3. A quick connection apparatus according to claim 1, wherein the electrical ground quick connect means comprises a block extending form the top to the bottom of the stack of boards and having bars extending therefrom wherein each board has compliant conductor type connectors at an end thereof contacting the bars.

4. A quick connection apparatus according to claim 1, wherein coolant supply quick connect means automatically align and engage upon pushing the modules into the frame.

5. A quick connection apparatus according to claim 4, wherein the coolant supply quick connect means automatically closes upon withdrawal of the board from the frame.

6. A mechanical and electrical connector apparatus for connecting a liquid cooled circuit board module having a cooling plate intermediate two circuit boards to a receiving frame, comprising:

a) plug type quick connect coolant connector means comprising a first member having a sliding plunger and a stationary sleeve and a second member having a sliding sleeve and a stationary plunger, wherein the sliding sleeve engages the stationary sleeve and the sliding plunger engages the stationary plunger so that upon pushing the members together, the sliding sleeve is pushed back by the stationary sleeve and the sliding plunger is pushed back by the stationary plunger, opening a flow path;

b) electrical contact means extending from a first end of the module and adapted for sliding into contact with a power bus;

c) electrical ground means extending from a first end of the module and adapted for sliding into a grounding portion of the frame;

d) pin connector means mounted on sliding blocks and adapted for making a plurality of electrical connections with the boards for input and output signals upon inserting a rod against the blocks of pins to make contact with the board.

7. A connector apparatus according to claim 6, wherein the electrical contact means comprise compliant type connectors.

8. A connector apparatus according to claim 6, wherein the electrical ground means comprise compliant type connectors.

9. A connector apparatus according to claim 6, wherein the pin connector means comprise zero insertion force connectors.

10. A connector apparatus according to claim 9, wherein the zero insertion force connectors are arranged in blocks sliding into and away from the circuit boards.

11. A connector apparatus according to claim 6, wherein the coolant connector means comprise connectors automatically sealing upon disengaging to prevent spilling.

12. A connector apparatus according to claim 6, wherein the plug type quick connect coolant connector means automatically align and engage upon pushing each board into the frame.

13. A connector apparatus according to claim 12, wherein the plug type quick connect coolant connector means automatically close off coolant fluid flow upon separation of each board from the frame.

14. A connector apparatus according to claim 6, wherein the plug type quick connect coolant connectors means comprises a first member having a sliding plunger and a stationary sleeve and a second member comprising a sliding sleeve and a stationary plunger.

15. A connector apparatus according to claim 14 wherein the sliding sleeve engages the stationary sleeve and the sliding plunger engages the stationary plunger so that upon pushing the members together, the sliding sleeve is pushed back by the stationary sleeve and the sliding plunger is pushed back by the stationary plunger, opening a flow path.

16. A connector apparatus according to claim 6, wherein the electrical connector means comprise a block attached to the frame and an arm attached to each module, wherein upon insertion of the module into the frame, the arm contacts the block.

17. A connector apparatus according to claim 6, wherein the electrical connector means comprise a block attached to the frame and an arm attached to each module, wherein upon insertion of the module into the frame, the arm contacts the block, and wherein the electrical ground means comprise a ground block of the computer engaging a bar attached to each module, wherein upon insertion of the module into the frame, the bar contacts the ground block.

18. A connector apparatus according to claim 17, wherein the arms and the bars further comprise compliant type connectors mounted thereon.

* * * * *

UNITED STATES PATENT AND TRADEMARK OFFICE

CERTIFICATE OF CORRECTION

PATENT NO. : 5,131,859
DATED : July 21, 1992
INVENTOR(S) : Bowen et al

It is certified that error appears in the above-indentified patent and that said Letters Patent is hereby corrected as shown below:

Column 6, line 26, Delete "a" after --of --.

Column 7, line 18 (claim 3), DELETE "form" and insert therefor --from --.

Signed and Sealed this

Twenty-eighth Day of December, 1993

*Attest:*

Bruce Lehman

BRUCE LEHMAN

*Attesting Officer*

*Commissioner of Patents and Trademarks*